US007726707B2

(12) United States Patent
Simchayoff et al.

(10) Patent No.: US 7,726,707 B2
(45) Date of Patent: Jun. 1, 2010

(54) ROTARY PAWL LATCH

(75) Inventors: Alan Simchayoff, Warrington, PA (US); Richard B. Langkamp, Jr., Hemlock, NY (US); D. Dale Turner, Honeoye Falls, NY (US); James H. Vickers, Media, PA (US)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 11/363,441

(22) Filed: Feb. 27, 2006

(65) Prior Publication Data

US 2006/0208503 A1 Sep. 21, 2006

Related U.S. Application Data

(60) Provisional application No. 60/657,118, filed on Feb. 27, 2005.

(51) Int. Cl.
*E05C 3/16* (2006.01)

(52) U.S. Cl. ..... 292/216; 292/201; 292/DIG. 23; 292/340; 292/341.18

(58) Field of Classification Search ..... 292/216, 292/201, DIG. 23, 240, 341.11, 341.12, 341.13, 292/341.19
See application file for complete search history.

(56) References Cited

U.S. PATENT DOCUMENTS 2,957,721 A * 10/1960 Sklaw et al. ..... 292/341.15
3,179,997 A * 4/1965 Jalinaud ..... 24/645
3,695,068 A * 10/1972 Eads et al. ..... 70/107
4,911,487 A * 3/1990 Rachocki ..... 292/216
5,069,491 A * 12/1991 Weinerman et al. ..... 292/48
5,342,103 A * 8/1994 Tame et al. ..... 292/341.17
5,411,302 A 5/1995 Shimada
5,439,260 A * 8/1995 Weinerman et al. ..... 292/48
6,158,787 A * 12/2000 Kutschat ..... 292/214
6,454,321 B1 * 9/2002 Parikh ..... 292/216
6,471,260 B1 * 10/2002 Weinerman et al. ..... 292/216
6,942,259 B2 9/2005 Marzolf et al.
7,147,257 B2 * 12/2006 Johansen et al. ..... 292/341.15
7,210,714 B2 * 5/2007 Berghahn et al. ..... 292/201

OTHER PUBLICATIONS

TRIMARK Website print out—www.trimarkcorp.com, 19 pages. Printed out on Apr. 13, 2004.
Three-page technical product information document entitled "050-0100 Two-Rotor Latch", found on website of TriMark Corporation at www.trimarkcorp.com.
Three-page technical product information document entitled "050-0600 Single Rotor Compartment Latch", found on website of TriMark Corporation at www.trimarkcorp.com.
Three-page technical product information document entitled "050-0300 Single Rotor Latch", found on website of TriMark Corporation at www.trimarkcorp.com.

* cited by examiner

*Primary Examiner*—Peter M Cuomo
*Assistant Examiner*—Kristina R Fulton
(74) *Attorney, Agent, or Firm*—Paul & Paul

(57) ABSTRACT

A latch assembly for releasably securing a striker in a rotary pawl latch. The latch assembly includes a housing, a rotary pawl, and an actuator. The housing can have one sidewall having a notch for receiving the striker. A trigger can be pivotally attached to the housing such that the actuator releases the rotary pawl thus opening the latch.

22 Claims, 10 Drawing Sheets

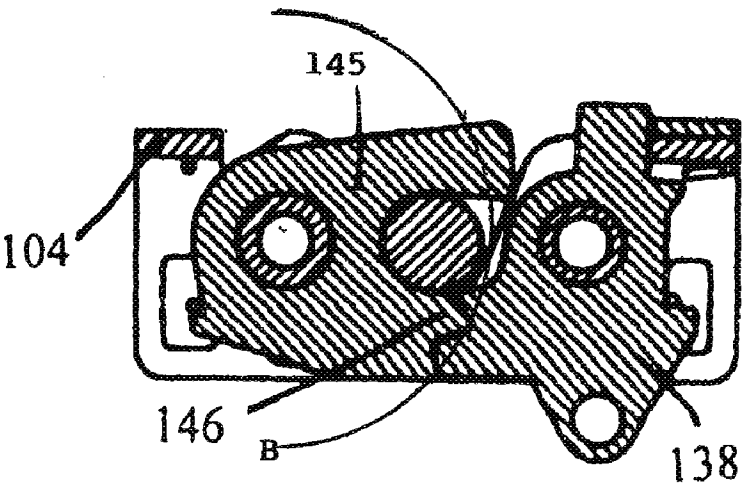
Fig. 15a
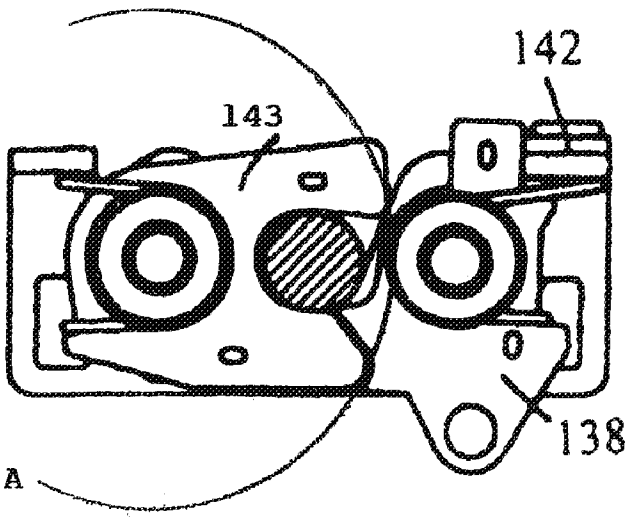

ROTARY PAWL LATCH

BACKGROUND OF THE INVENTION

1. Field of Invention

The present invention relates to the field of latch assemblies.

2. Brief Description of the Related Art

Latch assemblies are relied on in many applications for securing items, such as panels together. An important use for latches is in the automotive field, where there is a desire and need to access automotive compartments, such as, for example, passenger compartments of vehicles. Various latches for panel closures have been employed where one of the panels such as a swinging door or the like is to be fastened or secured to a stationary panel, doorframe, or compartment body. Although many latch assemblies are known in the prior art, none are seen to teach or suggest the unique features of the present invention or to achieve the advantages of the present invention.

Thus it will be understood that the latch components used to date have presented a number of drawbacks that typically have left the securing of a striker of a panel more awkward, time-consuming and difficult to install, remove, open, close, latch, and unlatch. In some instances, the selected latch, lock and hinge components have provided shorter than desired service lives and/or a lesser than the desired degree of security by virtue of their being relatively simple to defeat, force, break or bypass. In some instances the latch, lock and hinge components have been too weak to withstand the forces that have been encountered during normal service use (e.g., damage or unintended release has been noted as the result of these components being impacted by cargo that shifts as a pickup truck travels from place to place), or these components have taken on such size and bulk as to project into regions of cargo compartments that should be reserved for cargo.

Rotary latches capture a striker in two axes by rotation of a pawl which is activated by a trigger. There may be freedom of movement between the latch and the striker along the axis of the striker which may be cylindrical. This allows for manufacturing tolerance in the fit between the frame or first member to which the latch is mounted and the door or other second member to which the striker is mounted. In addition, difficulties have been encountered when a striker to which a latch such as a rotary latch is to be secured is off-center with respect to being aligned with a catch for engagement with the striker. There are instances when it is not practical to insure that tight tolerances will be maintained in door or frames such that the striker will always fall into the notch or mouth of the latch. The reason for misalignment between the latch and striker can be manufacturing and assembly tolerances, expansion and contraction of the structure due to environmental conditions, shifting of components due to wear during use or distortion of components due to abuse.

SUMMARY OF THE INVENTION

The invention addresses the foregoing and other needs and drawbacks of the prior art by providing a latch that is particularly well suited for engaging strikers which are off-center, characterized by novel features that also have other applications.

In accordance with another aspect of the preferred practice of the present invention, a rotary latch is provided to releasably latch strikers connected to a door or panel. The housings of these latch may be modified as needed to provide mounting surfaces that carry slotted holes or other mounting formations that can cooperate with mounting hardware such as threaded fasteners to mount the rotary latch in a manner that will allow for adjustment of the positioning of the latch so the latch will function properly. A trigger of the rotary latch of the present invention can be operated by a user, a rod, a cable or another member.

The striker assembly of the present invention allows for movement or float of the striker in the direction perpendicular to the axis of the striker. Further, the bolt of the striker assembly is urged to return to the center position when the striker is released from the latch. This centering position is desired so that the striker will be in position to engage the latch during the next engagement of the striker with the latch even if the striker and latch do not line up exactly for engagement.

The present invention is directed to a rotary latch system for securing the latch to a striker. The present invention includes a housing, a rotary pawl, an actuator, and a trigger means for releasing a striker when the latch is in a closed configuration. The pawl is pivotally attached to the housing and is rotationally movable between a closed or engaged configuration and an open or disengaged configuration. The latch can also have an intermediate position in which a striker can be held by the engagement of the rotary pawl with the actuating means both of which can be provided with a biasing means.

When a striker engages a portion of the rotary pawl the pawl is rotated such that pawl teeth engage actuator teeth. The teeth can be dimensioned and configured such that an intermediate engaging position is attained by the latch and the striker is held in position or if more force is applied a closed or latch configuration is achieved in which the striker will not be released from the latch until the trigger releases the pawl.

The rotary pawl can be made from three joinable plates for ease of assembly. In such a configuration, a striker engagement portion of a protuberance of the rotary pawl which can be made from one plate sweeps an arc which extends further than an actuator engagement portion of the rotary pawl which can be made from two plates which are joinable. The plates can be joined by studs on the plates which fit up to depressions on an adjoining plate. Because striker engagement portion of the protuberance extends further than the actuator engagement portion of the pawl, the latch of the present invention can be of a smaller size as compared to other rotary latches because the pawl teeth can be closer to the pawl pivot point.

The latch of the present invention also has the advantage that the latch can have a single housing side plate which can be fitted interchangeably with the pawl on one side of the housing and the actuator on the other side of the housing.

BRIEF DESCRIPTION OF THE DRAWINGS

FIG. 15*a* is a side-by-side comparison of FIGS. 8 and 13 demonstrating that the striker engaging portion of the pawl sweeps an arc (A) at a greater distance from the pivot axis than an arc (B) by the actuator engaging portion of the pawl.

DETAILED DESCRIPTION OF THE INVENTION

Figure 1:
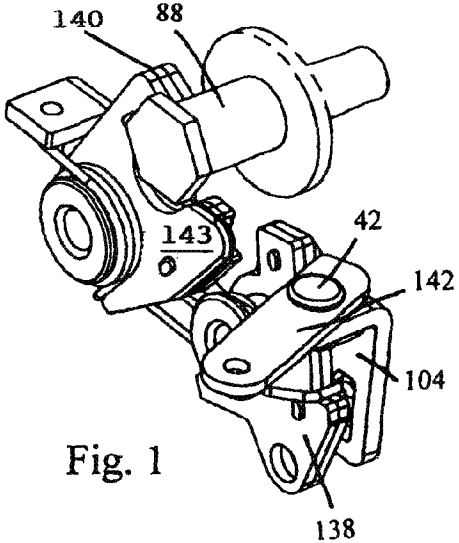
FIG. 1 is an isometric view of the rotary pawl latch according to the present invention shown in the open position receiving a striker.
Figure 2:
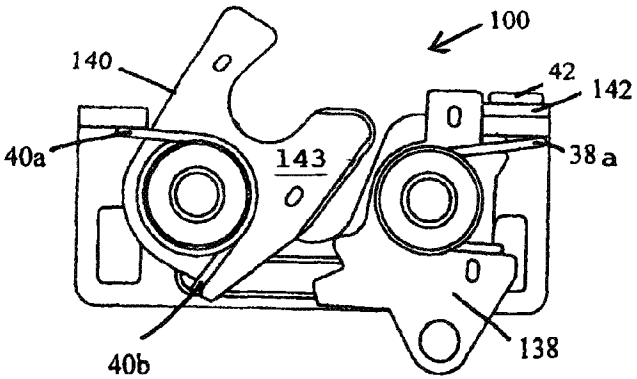
FIG. 2 is a front side elevational view of the rotary pawl latch of FIG. 1 shown in the open position.
Figure 3:
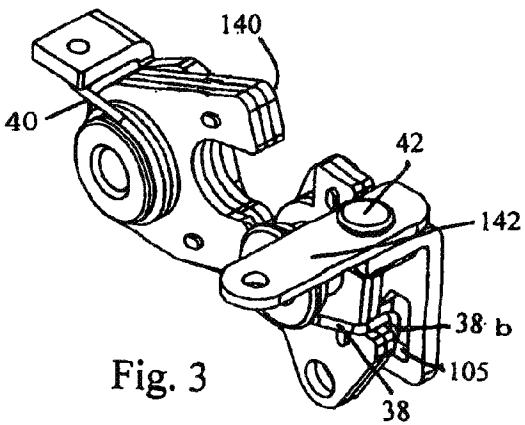
FIG. 3 is an isometric view of the rotary pawl latch according to the present invention shown in an intermediate closed position.
Figure 4:
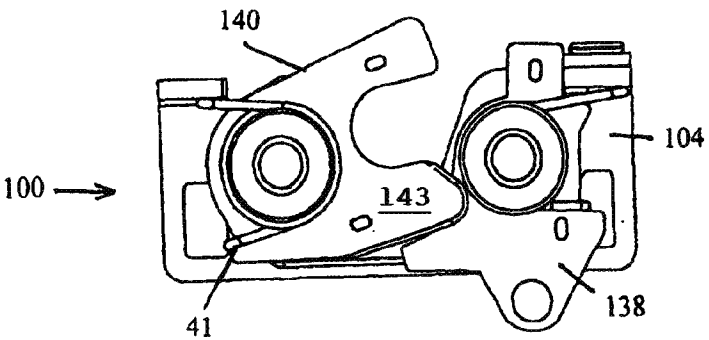
FIG. 4 is a front side elevational view of the rotary pawl latch of FIG. 1.
Figures 5, 6, 7, 8:
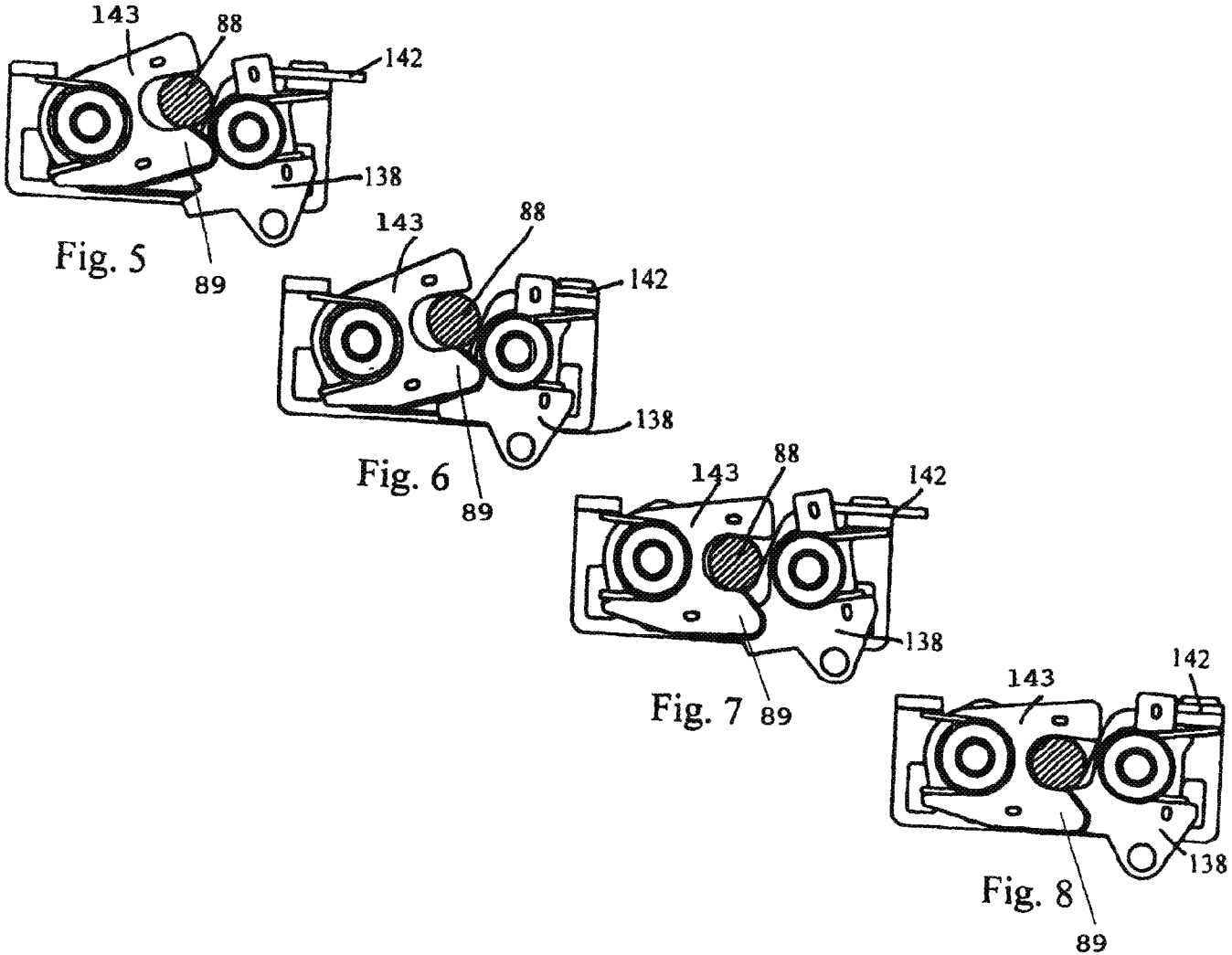
FIG. 5 is a front side elevational view of the rotary pawl latch of FIG. 1 shown with the rotary pawl of the latch engaging a striker.
FIG. 6 is a front side elevational view of the rotary pawl latch of FIG. 1 shown with the rotary pawl of the latch engaging a striker in an intermediate closed position.
FIG. 7 is a front side elevational view of the rotary pawl latch of FIG. 1 shown with a tooth of the rotary pawl of the latch engaging a tooth on the actuator.
FIG. 8 is a front side elevational view of the rotary pawl latch of FIG. 1 shown in the closed position.
Figure 9:
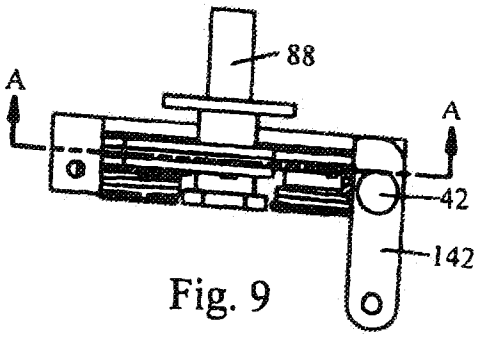
FIG. 9 is a top plan view of the rotary pawl latch of FIG. 1.

Referring to FIGS. 1-17, a latch 100 made in accordance with the present invention can be seen. The latch 100 includes a latch housing 104 as seen in FIG. 1, a pawl 140, an actuator 138, and trigger means 142 for selectively moving the latch 100 from the closed position in which the latch 100 can be engaging a striker 88. In the illustrated embodiment, trigger 142 is shown in the form of a lever which pivots about trigger pivot means 42 for selectively moving actuator 138 which is acted upon by actuator biasing means 38. Actuator biasing means 38, here a spiral spring has spring leg 38*a* which engages housing 104 and spring leg 38*b* which engages cutout 105 in the housing 104. Similarly, pawl biasing means 40, here a spiral spring has spring leg 40*a* which engages housing 104 and spring leg 40*b* which engages pawl spring engagement means 41 on pawl 140. Pawl biasing means 40 biases the pawl 140 to the open position while the actuator biasing means 38 biases the actuator 138 in the clockwise direction as seen in FIG. 2.

Figure 10:
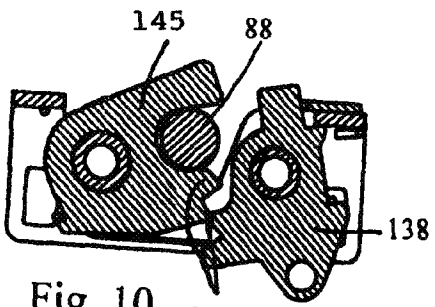
FIG. 10 is a sectional view of the rotary pawl latch of the present invention taken along line A-A of FIG. 5 shown with the rotary pawl of the latch engaging a striker.
Figure 11:
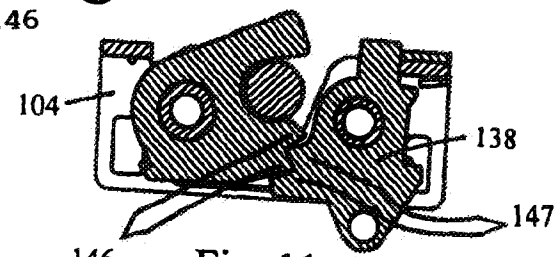
FIG. 11 is a sectional view of the rotary pawl latch of the present invention taken along line A-A of FIG. 6 shown with the rotary pawl of the latch engaging a striker in an intermediate closed position.
Figure 12:
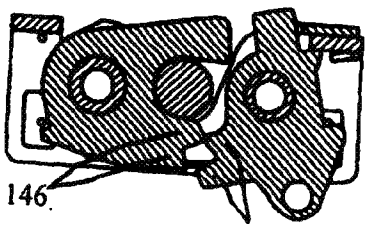
FIG. 12 is a sectional view of the rotary pawl latch of the present invention taken along line A-A of FIG. 7 shown with a tooth of the rotary pawl of the latch engaging a tooth on the actuator.
Figure 13:
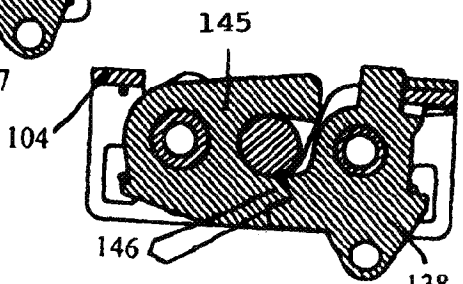
FIG. 13 is a sectional view of the rotary pawl latch of the present invention taken along line A-A of FIG. 8 shown in the closed position.
Figure 14:
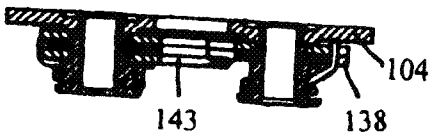
FIG. 14 is a sectional view of the rotary pawl latch of the present invention taken along line B-B of FIG. 15.
Figure 15:
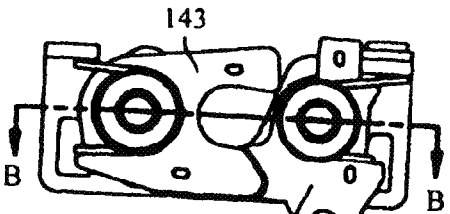
FIG. 15 is a front view of the rotary pawl latch of the present invention in the closed position.
Figure 17:
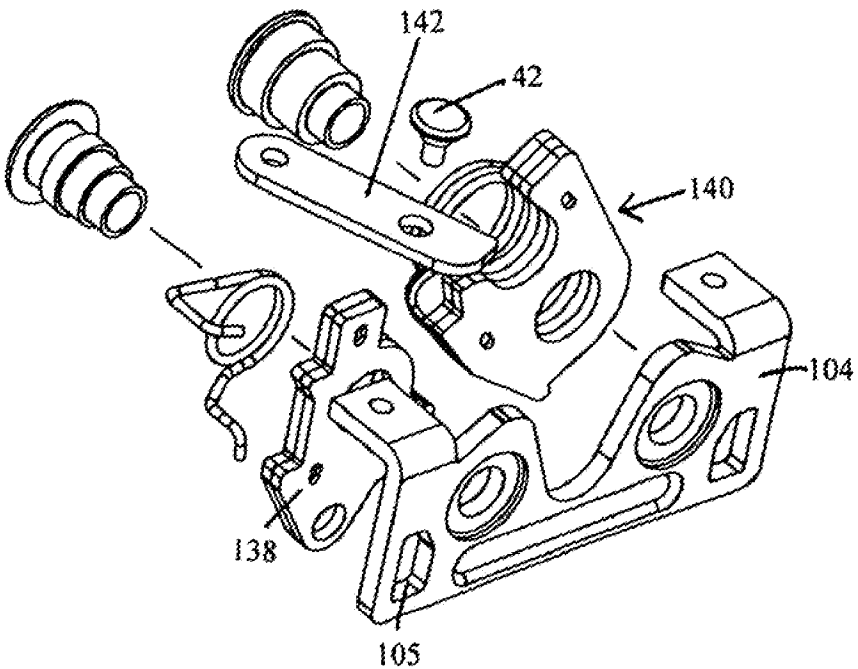
FIGS. 16 and 17 are exploded views of the latch of the present invention
Figure 16:
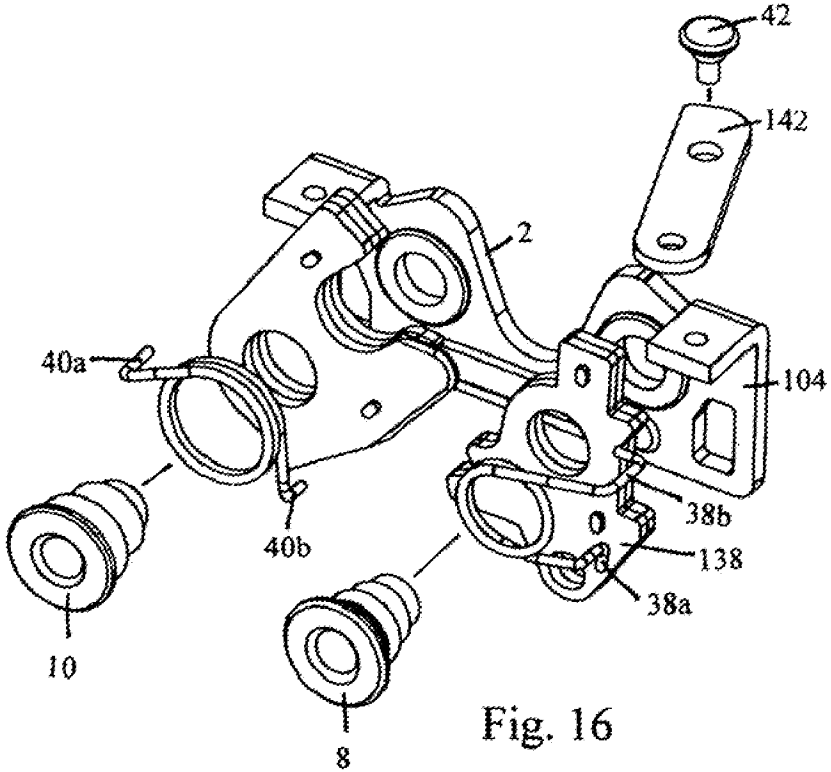

As seen in FIG. 10, as a striker 88 engages the striker engagement means 143 of the pawl 140, the pawl 140 rotates such that an actuator engaging portion 146 comprised of pawl teeth engages the actuator teeth of the pawl engaging portion 147 of the actuator 138. In FIG. 11, the pawl 140 and actuator 138 are engaged by the actuator engaging portion 146 and pawl engaging portion 147 such that the latch 100 is in an intermediate closed position in which the striker 88 is captured. Further movement as seen in FIG. 12 of the striker 88 results in one of the pawl teeth moving past one of the actuator teeth such that the latch 100 attains a closed position as seen in FIG. 13.

Figure 18:
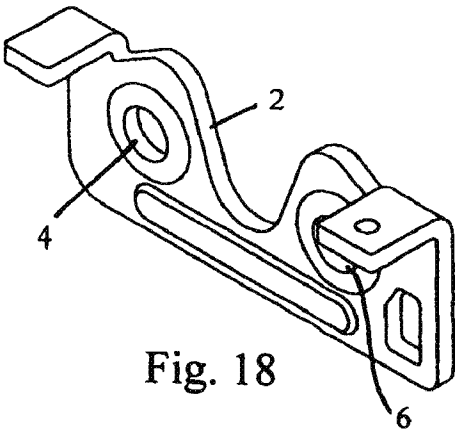
FIG. 18 is an isometric view of the housing of the latch of the present invention.
Figure 20:
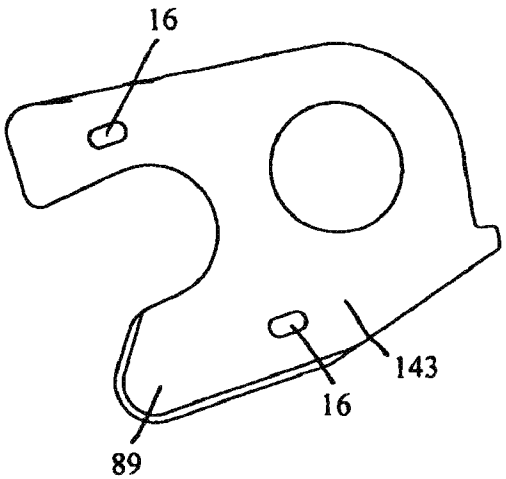
FIG. 20 is a side elevational view of the striker engagement means of the pawl of the latch of the present invention.
Figure 22:
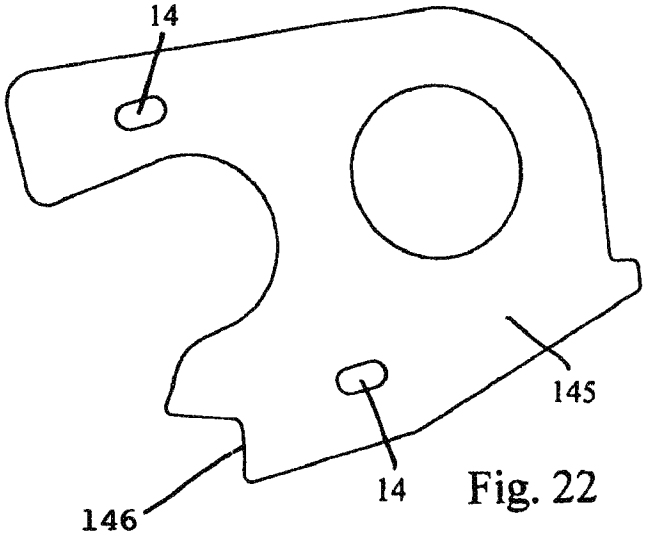
FIG. 22 is a side elevational view of the actuator engagement means of the pawl of the latch of the present invention.
Figure 19:
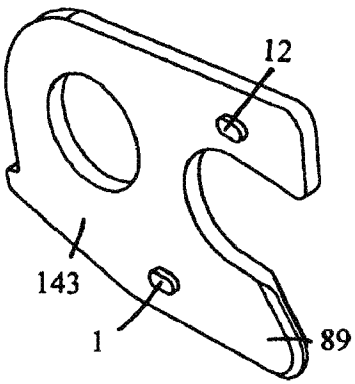
FIG. 19 is an isometric view of the striker engagement means of the pawl of the latch of the present invention.
Figure 21:
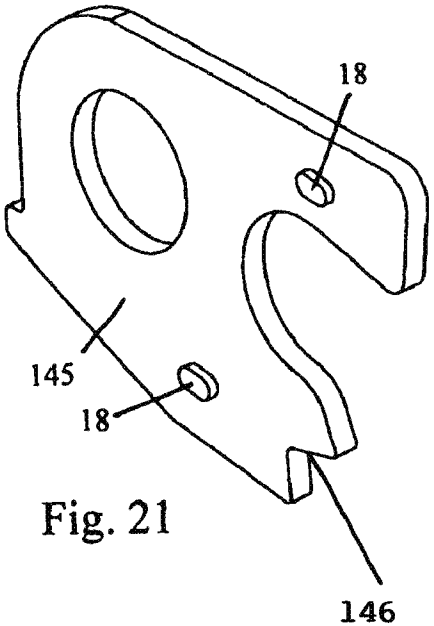
FIG. 21 is an isometric view of the actuator engagement means of the pawl of the latch of the present invention.
Figure 23:
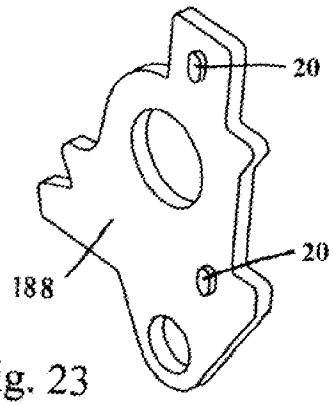
FIG. 23 is an isometric view of the pawl engagement means of the pawl of the latch of the present invention.
Figure 24:
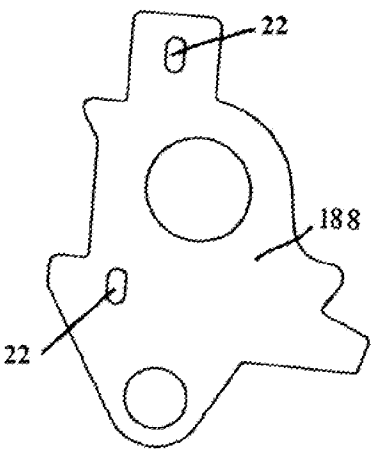
FIG. 24 is a side elevational view of the pawl engagement means of the pawl of the latch of the present invention.

The housing 104 as seen in FIG. 18 has notch 2 for engagement with a striker 88 and also has apertures 4 and 6 which receive pawl rivet 10 and actuator rivet 8. As seen in FIGS. 19 to 22 pawl 140 can be formed from an actuator engagement means 145 having an actuator engaging portion 146 and a striker engagement means 143 having striker engagement portion 89. Striker engagement means 143 has studs 12 which fit into depressions 14 of actuator engagement means 145. The studs 12 and depressions 14 make the arrangement of the pawl 140 such that the pawl 140 can be mounted on either of apertures 4 and 6 of the housing 104 thereby yielding either a right hand or left hand version of the latch 100. Accordingly, stud 16 on the striker engagement means 143 can be fit up to depression 18 on the actuator engagement means 145. Similarly, actuator 138 can be formed from two plates 188 as seen in FIGS. 23 and 24 in which stud 20 on first actuator piece 138 fits into depression 22 on second actuator piece 138.

Figure 25:
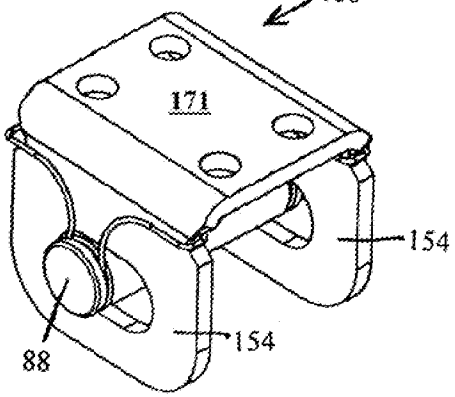
FIG. 25 is an isometric view of a first embodiment of a striker assembly shown with a striker.
Figure 26:
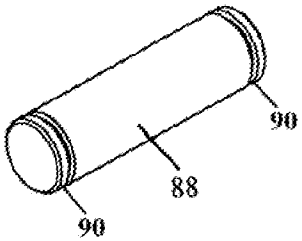
FIG. 26 is an exploded view of a first embodiment of a striker assembly of the present invention shown with a striker.
Figure 26:
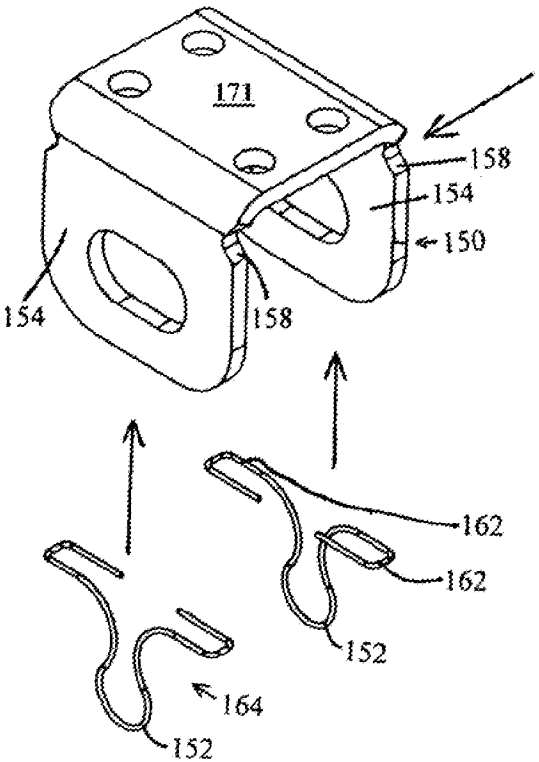
Figure 27:
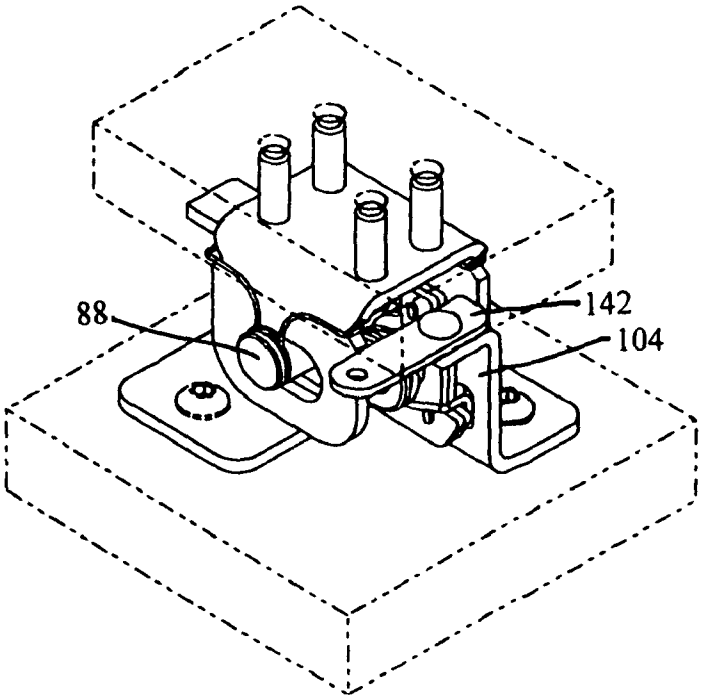
FIG. 27 is an isometric view of the striker assembly of FIG. 26 shown fastened to a first member and the latch of FIG. 1 fastened to a second member and capturing the striker.
Figure 28:
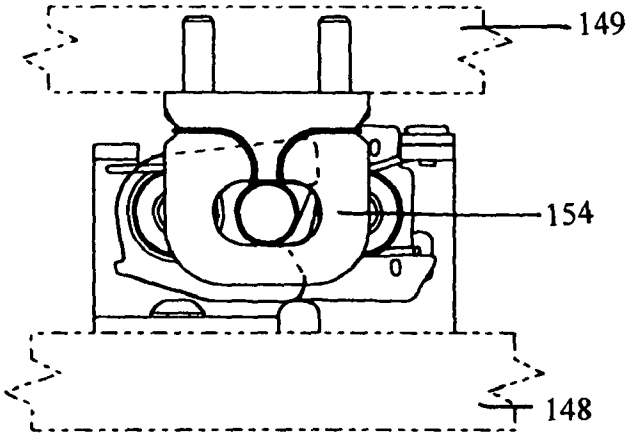
FIG. 28 is a side elevational view of the striker assembly of FIG. 26 shown capturing a striker in a centering position.
Figure 29:
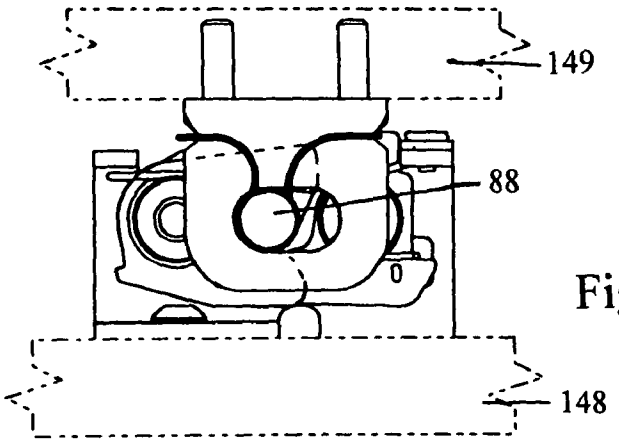
FIG. 29 is a side elevational view of the striker assembly of FIG. 26 shown capturing a striker in an off-center position.
Figure 29A:
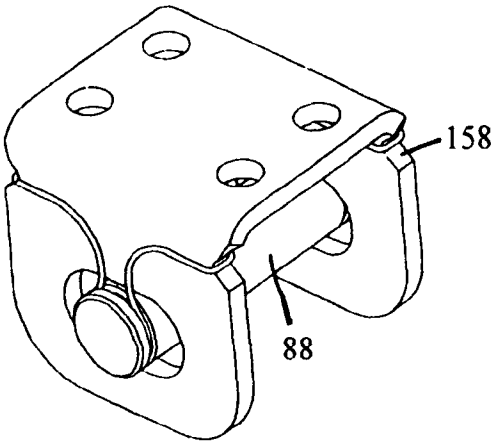
FIG. 29*a* is an isometric view of the striker assembly of FIG. 26 shown capturing a striker in a centering position.

As seen in FIGS. 25 to 29, the present invention also includes a striker assembly 160 which is formed from striker 88, a striker housing 150 having a striker housing top portion 171 having sidewalls 154. The top of each sidewall 154 has sidewall notch 158 in which spring loops 162 of first striker housing spring 164 engage. First striker housing spring 164 has a spring portion 152 for engaging a surface 90 of the striker 88 and maintaining the striker 88 in a centering position in the sidewall aperatures 177 of the two sidewalls 154 whereby the floating first striker housing spring 164 permits movement of the striker 88 in the two sidewall aperatures 177 upon impact of the pawl 140 with the striker. As seen in FIGS. 25, 27 and 29, the striker assembly 160 can accommodate a striker 88 in an off-center position and by the biasing forces of first striker housing spring 164 return the striker 88 to a centering position as seen in FIG. 29*a*. As shown in FIGS. 28 and 29 the striker assembly 160 can fasten first panel 148 to second panel 149.

Figure 30:
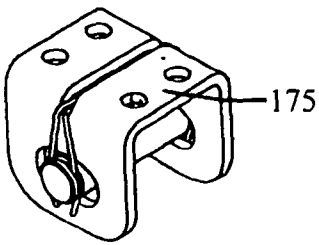
FIG. 30 is an isometric view of a second embodiment of a striker assembly of the present invention shown with a striker.
Figure 32:
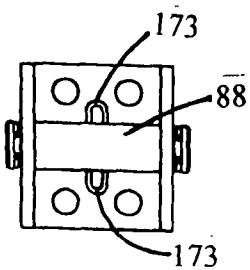
FIG. 32 is a bottom view of the striker assembly of FIG. 30 shown with a striker.
Figure 31:
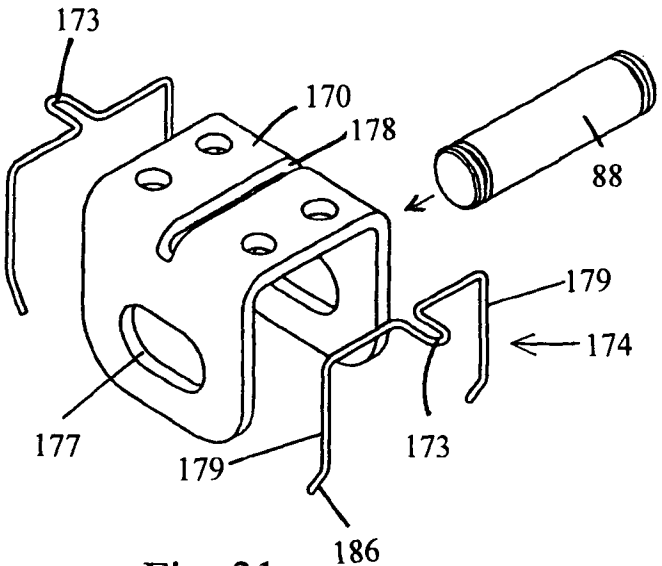
FIG. 31 is an exploded view of the striker assembly of FIG. 30 shown with a striker.

Another embodiment of the self-centering striker latch assembly of the present invention is shown in FIGS. 30-32 in which striker housing 170 has a portion of second striker housing spring 174 inserted through striker housing slot 178 such that u-shaped portion 173 is bent up against the bottom of the striker housing top portion 175, thus biasing striker 88 into a centering position in sidewall aperature 177. Second striker housing spring 174 can have a bend 186 proximate each end of spring legs 179 such that the striker 88 engages spring legs 179 at a position between the bend 186 and the end of said spring legs 179 and at a position between the bend 186 and the u-shaped portion 173.

Figure 34:
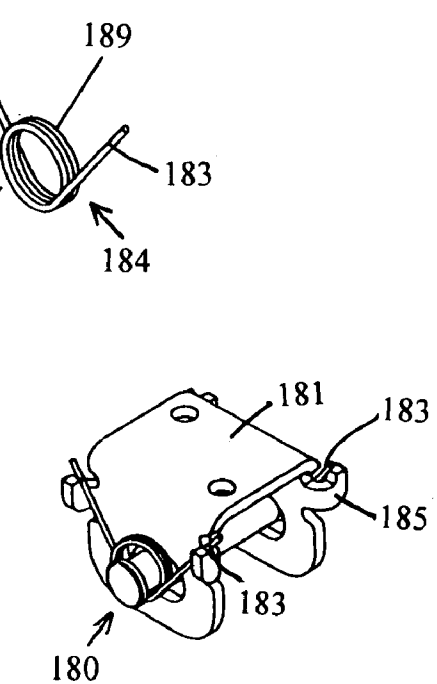
FIG. 34 is an isometric view of the striker assembly of FIG. 33.
Figure 33:
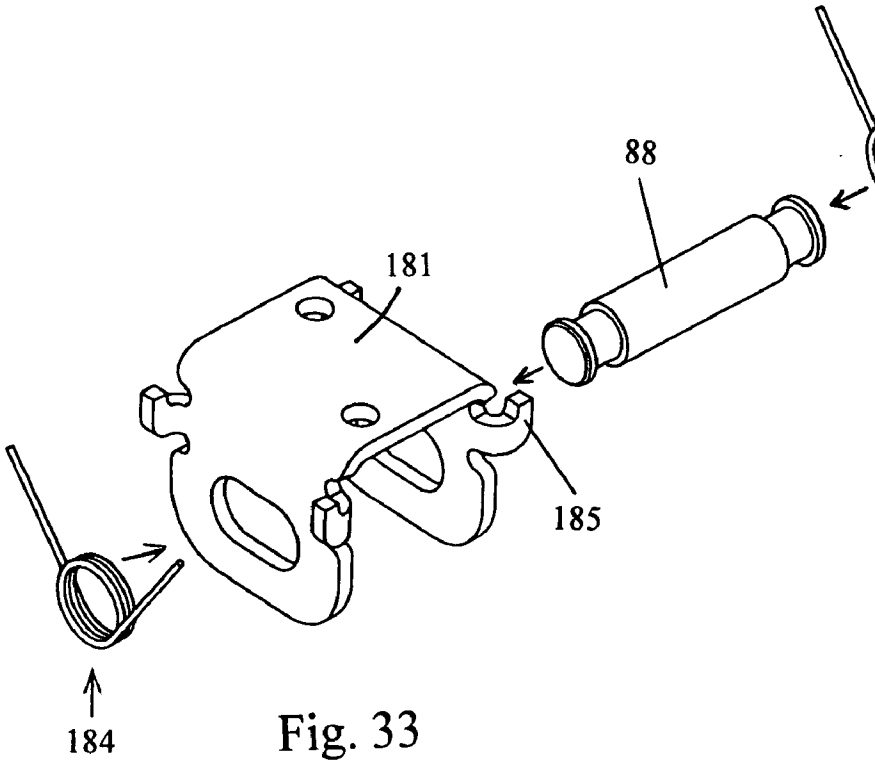
FIG. 33 is an exploded view of a third embodiment of a striker assembly of the present invention shown with a striker.

As shown in yet another embodiment shown in FIGS. 33 and 34, third striker housing spring 184 has spring legs 183 which are biased against striker housing protuberance 185 such that striker assembly 180 biases the striker 88 in a centering position in striker housing 181. Third striker housing spring 184 has a coil portion 189 for engaging a surface of the striker 88 outside of the housing and maintaining the striker 88 in a centering position.

It will be apparent to those skilled in the art that various modifications can be made to the latch of the present invention without departing from the scope and spirit of the invention, and it is intended that the present invention cover modifications and variations of the latch which are within the scope of the appended claims and their equivalents.

The invention claimed is:

1. A latch capable of releasably securing a first member in a closed configuration relative to a second member by engaging a striker supported on the second member, said latch comprising:

a housing;

an actuator; and a pawl pivotally attached to a wall of said housing and being movable between a closed position and an open position about a pivot-axis, said pawl being provided with a biasing means for biasing the pawl toward the open position, said pawl having an actuator engaging portion and a striker engaging portion being axially adjacent on a similar end of said pawl, said actuator engaging portion being rotatable about said pivot-axis on a first plane perpendicular to said pivot axis and said striker engaging portion being rotatable about said pivot-axis on a second plane parallel to said first plane, and said striker engaging portion being dimensioned and configured to sweep an arc which extends further out from said pivot-axis about which said pawl pivots when said pawl is pivoted than an arc which is swept by said actuator engaging portion when said pawl is pivoted;

wherein said actuator is pivotally attached to said housing and movable between a pawl-releasing position and a pawl-retaining position, said actuator being provided with a biasing means for biasing the actuator toward the pawl-retaining position, said actuator having a pawl engaging portion, said pawl engaging portion engages said actuator engaging portion such that said actuator is pivoted by said pawl upon pivoting of said pawl to the closed position, and wherein when said pawl impacts the striker during closing of the first and second members together, said pawl is moved to the closed position, such that said pawl and said actuator are in an opposing relationship about the striker in the closed position, and said pawl engaging portion retains said pawl in the closed position, and wherein pivoting of said actuator allows said biasing means for biasing the pawl to rotate said pawl to the open position to thereby permit said latch to be disengaged from the striker.

2. A latch capable of releasably securing a first member in a closed configuration relative to a second member by engaging a striker supported on the second member, said latch comprising:

a housing;

an actuator; and a pawl pivotally attached to said housing and being movable between a closed position and an open position, said pawl being provided with a biasing means for biasing the pawl toward the open position, said pawl comprising a first plate and a second plate, said first plate and second plate being rotatable about a pivot-axis and said first plate being parallel to said second plate, said first plate comprising a striker engaging portion and said second plate comprising an actuator engaging portion said striker engaging portion and said actuator engaging portion being axially adjacent on a similar end of said pawl, and said striker engaging portion being dimensioned and configured to sweep an arc which extends further out from said pivot-axis about which said pawl pivots when said pawl is pivoted than an arc which is swept by said actuator engaging portion when said pawl is pivoted;

wherein said actuator is pivotally attached to said housing and movable between a pawl-releasing position and a pawl-retaining position, said actuator being provided with a biasing means for biasing the actuator toward the pawl-retaining position, said actuator having a pawl engaging portion, said pawl engaging portion engages said actuator engaging portion such that said actuator is pivoted by said pawl upon pivoting of said pawl to the closed position, and wherein when said pawl impacts the striker during closing of the first and second members together, said pawl is moved to the closed position, such that said pawl and said actuator are in an opposing relationship about the striker in the closed position, and said pawl engaging portion retains said pawl in the closed position, and wherein pivoting of said actuator allows said biasing means for biasing the pawl to rotate said pawl to the open position to thereby permit said latch to be disengaged from the striker.

3. The latch according to any one of claims 1 and 2 wherein said pawl biasing means is a pawl spring.

4. The latch according to any one of claims 1 and 2 wherein said actuator biasing means is an actuator spring.

5. The latch according to any one of claims 1 and 2 wherein said pawl engaging portion and said actuator engaging portion are dimensioned and configured to permit said pawl and said actuator to be maintained in an intermediate position in which the striker engages said pawl and said actuator engaging portion engages said pawl engaging portion.

6. The latch according to claim 5 wherein the actuator engaging portion has an actuator engaging tooth, and the pawl engaging portion has a first pawl engaging tooth and an adjacent second pawl engaging tooth, wherein when said pawl and said actuator are in the intermediate position said actuator engaging tooth engages between said first pawl engaging tooth and said second pawl engaging tooth.

7. The latch according to any one of claims 1 and 2 wherein said housing has an aperture and said actuator comprises a first actuator plate and an opposed second actuator plate, said first actuator plate and second actuator plate being adjacent to each other and in direct contact with one another such that said actuator has two major exterior surfaces and one of said two major exterior surfaces faces said housing.

8. The latch according to claim 7 wherein the actuator biasing means is a spring having a leg at each of two ends of said spring and one of said legs extends into said aperture in said housing.

9. The latch according to claim 7 wherein one of said first actuator plate and said second actuator plate has a depression and the other of said first actuator plate and second actuator plate has a stud dimensioned and configured for engagement with said depression so as to maintain said first actuator plate and said second actuator plate fixed relative to each other.

10. The latch according to any one of claims 1 and 2 wherein the housing has a u-shaped notch for receiving the striker.

11. The latch according to any one of claims 1 and 2 wherein said striker engaging portion is a first section of said pawl and said actuator engaging portion is a second section of said pawl, wherein said first section and second section being in direct contact with each other and fixed relative to each other.

12. A latch system capable of releasably securing a first member in a closed configuration relative to a second member, wherein said latch system comprises a latch according to any one of claims 1 and 2 and a floating striker housing supporting a striker on the second member, said floating striker housing comprising:

a top portion having two opposite ends;

an opposed sidewall extending from each of said two opposite ends of said top portion, each of said sidewalls having an aperture for receiving the striker; and two floating striker housing springs, wherein said two floating striker housing springs maintain the entire striker parallel to said top portion and in a centering position in said apertures of said sidewalls whereby said floating striker housing spring permits movement of the striker in said apertures upon impact of said pawl with the striker.

13. The latch system according to claim 12, wherein said floating striker housing further comprises:

two sidewall notches on the periphery of each of said sidewalls, each sidewall notch being located proximate the junction of each of said sidewalls with said top portion of said floating striker housing;

each of said two floating striker housing springs having two spring legs, wherein each of said spring legs forms a spring loop, each of said spring loops being received and engaged by one of said sidewall notches of each of said two sidewalls; and each of said floating striker housing springs having a spring portion for engaging a surface of the striker.

14. The latch system according to claim 12, wherein said floating striker housing further comprises:

a top portion slot which extends through said top portion and which extends between said opposed sidewalls; and said two floating striker housing springs having a u-shaped portion which is biased against a face of said top portion, each of said two floating striker housing springs having two spring legs for engaging a surface of the striker.

15. The latch system according to claim 14 wherein each of said spring legs has a bend proximate an end of said spring leg such that the striker engages said spring leg at a first position between said bend and said end of said spring leg and at a second position between said bend and said u-shaped portion.

16. The latch system according to claim 12, wherein said floating striker housing further comprises:

two sidewall protuberances on the periphery of each of said sidewalls, each sidewall protuberance being located proximate the junction of each of said sidewalls with said top portion of said floating striker housing;

two floating striker housing springs, each of said floating striker housing springs having two spring legs, each of said spring legs being received and engaged by one of said sidewall protuberances of each of said two sidewalls;

and each of said floating striker housing springs having a coil portion for engaging a surface of the striker.

17. A floating striker housing comprising:

a top portion having two opposite ends;

an opposed sidewall extending from each of said two opposite ends of said top portion, each of said sidewalls having an aperture;

a striker extending through said sidewalls within said apertures and capable of moving within said apertures; and two floating striker housing springs engaging the housing, each of said two floating striker housing springs has two spring legs extending proximally from the junction of each of said sidewalls and said top portion, and each of said floating striker housing springs having a spring portion for engaging a surface of the striker, wherein said two floating striker housing springs maintain the entire striker parallel to said top portion and in a centering position in said apertures of said sidewalls.

18. The floating striker housing according to claim 17, further comprising:

two sidewall notches on the periphery of each of said sidewalls, each sidewall notch being located proximate the junction of each of said sidewalls with said top portion of said floating striker housing;

wherein each of said spring legs forms a spring loop, each of said spring loops being received and engaged by one of said sidewall notches of each of said two sidewalls.

19. The floating striker housing according to claim 17, further comprising:

a top portion slot which extends through said top portion and which extends between said opposed sidewalls; and said two floating striker housing springs having a u-shaped portion which is biased against a face of said top portion.

20. The floating striker housing according to claim 19 wherein said spring portion comprises a bend proximate an end of each of said spring legs such that the striker engages each of said spring legs at a first position between said bend and said end of said spring leg and at a second position between said bend and said u-shaped portion.

21. The floating striker housing according to claim 17, further comprising:

two sidewall protuberances on the periphery of each of said sidewalls, each sidewall protuberance being located proximate the junction of each of said sidewalls with said top portion of said floating striker housing;

said spring legs being received and engaged by one of said sidewall protuberances of each of said two sidewalls;

and said spring portion in the shape of a coil.

22. The latch according to any one of claims 1 and 2, further comprising a trigger, said trigger being dimensioned and configured such that pivoting of said trigger pivots said actuator so as to permit the pawl to rotate to the open position.

* * * * *